United States Patent [19]

Abbott

[11] 3,980,533

[45] Sept. 14, 1976

[54] BRASS PLATING

[75] Inventor: Charles N. Abbott, Dayton, Ohio

[73] Assignee: Abbco, Inc., Dayton, Ohio

[22] Filed: Feb. 21, 1975

[21] Appl. No.: 551,595

[52] U.S. Cl. ..... 204/44

[51] Int. Cl.[2] ..... C25D 3/56; C25D 3/58

[58] Field of Search ..... 204/44, 123, 105 M, 204/106, 114

[56] References Cited

UNITED STATES PATENTS

| | | | |
|---|---|---|---|
| 1,573,233 | 2/1926 | Eldredge | 423/106 |
| 3,620,937 | 11/1971 | Ligowski et al. | 204/44 |

FOREIGN PATENTS OR APPLICATIONS

| | | | |
|---|---|---|---|
| 1,005,162 | 9/1965 | United Kingdom | 204/106 |

*Primary Examiner*—G. L. Kaplan

*Attorney, Agent, or Firm*—Francis M. Crawford

[57] ABSTRACT

The present invention relates to the electrodeposition of brass in a form suitable for use as undercoats for subsequently applied metal coatings, and to electrolytes suitable therefor, comprising a soluble manganous compound and preferably an agent which prevents precipitation of manganese from said electrolyte.

4 Claims, No Drawings

BRASS PLATING

The present invention relates to electrolytes for the electrodeposition of brass comprising soluble manganous compounds. More particularly, it relates to brass electrolytes containing a soluble manganous compound and a chelating or sequestering agent.

Electrolytes for the electrodeposition of brass have been extensively used in the past and in general comprise essentially copper and zinc cyanides, sodium cyanide and sodium hydroxide. Brass metal deposited from such electrolytes have been employed for many purposes and in particular for use as undercoats over which other metals are applied by electrodeposition. When used for the latter purpose it is particularly essential that the electrodeposited brass be fine grained and smooth since physical defects in the brass coating will generally be transferred to the metal coatings subsequently applied thereover. For example, coarse grains in the brass coating will generally show through subsequently applied coatings of other metals. Numerous methods have been investigated for inhibiting or at least reducing the undesirable effects of defective brass coatings. None of the prior methods, however, has satisfactorily reduced the undesired properties in electrodeposited brass coatings without at the same time either substantially increasing the costs of the operation or introducing other undesired factors.

It has now be discovered, in accordance with the present invention, that most of the previous disadvantages incurred in the electrodeposition of brass, and particularly the graininess of deposited coatings can be satisfactorily and economically overcome by incorporating into the brass electrolytes relatively small amounts of a soluble manganese compound, preferably, a soluble manganous compound. Preferred compounds include manganous sulfate, manganous carbonate and manganous gluconate although other manganous compounds may likewise be used so long as sufficiently soluble in the electrolyte to give the required quantity of manganous ions when plating at the required times and temperatures. Under such circumstances brass plates have been produced by electrodeposition which were smooth, substantially free from grain and generally quite satisfactory for use as undercoats for other electrodeposited metals and alloys.

Under preferred conditions the electrolytes used should contain 70 to 30%, by weight, of copper metal and 30 to 70%, by weight, of zinc metal, the total metal concentration in the electrolyte being 10–60 g/l with an optimum range of 30–45 g/l. The optimum ratio of copper to zinc is generally of the order of 55–60%, by weight, of copper metal to 45–40%, by weight, of zinc metal. In each instance the electrolyte also contains the conventional amounts of soluble alkali metal or alkaline earth metal cyanide as well as the conventional amount of soluble alkali metal or alkaline earth metal hydroxide.

The amounts of manganous compound used in the above-described brass electrolyte can be varied so long as the amount used is not sufficient to cause precipitation in the electrolyte during the electroplating. In general, it is preferred to incorporate in the electrolyte sufficient manganous compound to give 0.00005g/l to 0.1 g/l, by weight, calculated as manganese metal, with the optimum range being of the order of 0.0002–0.02 g/l.

While effective in reducing the formation of grain in the electrodeposition of brass the manganous compounds dissolved in the electrolytes have a tendency to precipitate from the electrolyte during the operation thus causing the formation of an undesirable sludge in the electrolytic bath. It has been found, however, that this tendency for the formation of precipitates of manganous compounds can be materially reduced and even completely eliminated by incorporating in the electrolytic bath along with the manganous compound small amounts of a chelating or sequestering agent, such as, for example, sodium gluconate, tartaric acid, sorbitol, ethylenediaminetetra acetic acid, or citric acid. The incorporation of 0.001–10 g/l, and preferably 0.05–1.0 g/l, by weight, of such an agent to the electrolytic bath along with the amounts of manganous compounds above specified has been found to be quite effective in preventing the precipitation of the manganous compounds, without otherwise deleteriously affecting the plating operation. It should be noted, however, that when used in the lower specified amounts no precipitation of the manganous compound ordinarily takes place even in the absence of the chelating or sequestering agent, although it may be desired to use small amounts of the latter merely as an insurance factor.

In some instances the formation of white bands during the electrodeposition of the brass will be noted. This appears to be due to the presence of some impurity in the electrolyte and its complete absence is not necessary for satisfactory plating. Its presence, therefore, should not be regarded as an indication of the inoperativeness of the disclosed and claimed improvement.

In carrying out the process of the claimed invention the electrodeposition of the brass should be effected preferably within the range of 20–40 amperes/ft$^2$ current density, although the effective amperage as determined on a Hull Cell panel has been found to be within the range of 0.3–100 amperes/ft$^2$, and higher.

The electrodeposition is carried out within the range of 60°–90°F, and preferably within the range of 70°–75°F.

The following specific examples are given to illustrate the effect of using manganous compounds both with and without the presence of chelating and sequestering agents in conventional electrolytic baths for the electrodeposition of brass. It is understood, however, that the disclosed invention is not to be limited to these specific examples since the plating bath may be varied in any conventional manner, as well as the electroplating procedure, without departing from the scope of the claimed invention, so long as the conditions hereinabove set out are substantially followed.

EXAMPLE I

In this series brass was electrodeposited on metal plates under varying conditions from the following base electrolyte:

| | |
|---|---|
| Sodium cyanide | 5.09 oz/gal. |
| Sodium hydroxide | 4.57 oz/gal. |
| Copper (as cyanide) | 2.33 oz/gal. |
| Zinc (as cyanide) | 1.74 oz/gal. |
| Total metal | 4.07 oz/gal. |
| % copper metal | 52.3 |

Panel No. 1 electroplated in the above base electrolyte at a current range of 0.3–100 amperes/ft$^2$, for 15 minutes, to a final temperature of 73° F showed typical graining streaks in the 3–6 ampere/ft$^2$ range.

Panel No. 2 was electroplated under the same conditions as panel No. 1 with the exception that 0.00375 g/l of manganous sulfate was incorporated in the base electrolyte. In this case, the grainy band present in panel No. 1 was completely eliminated.

Panel No. 3 was electroplated as described above in the base electrolyte containing 0.025 g/l of manganous sulfate. The resulting plate showed no grain but a heavy precipitate formed in the plating solution, indicating the desirability of an agent to prevent precipitation of the manganous compound when concentrations higher than 0.00375 g/l were used.

EXAMPLE II

In this experiment a base electrolyte of the following composition was used:

| | |
|---|---|
| Sodium cyanide | 5.42 oz/gal. |
| Sodium hydroxide | 4.30 oz/gal. |
| Copper (as cyanide) | 2.52 oz/gal. |
| Zinc (as cyanide) | 1.74 oz/gal. |
| Total metal | 4.26 oz/gal. |
| % Copper in metal | 59.2 |

A panel electroplated in the above base electrolyte gave the typical grainy metal coating under the conditions noted in Example I.

A panel electroplated under similar conditions in the above base electrolyte to which had been added 0.15 g/l of sorbitol and 0.00875 g/l of manganous sulfate showed the complete elimination of graining and no precipitate formation in the electroplating bath. Similar results were obtained when the same amount of gluconic acid was substituted for the sorbitol. Similar results were also obtained by the substitution of sodium gluconate.

EXAMPLE III

Panels were electroplated in electrolytes having the following compositions, the amounts given in each instance representing ounces of material per gallon:

| | | | | | | |
|---|---|---|---|---|---|---|
| Sodium cyanide | 4.70 | 4.97 | 6.10 | 4.45 | 6.00 | 8.56 |
| Sodium hydroxide | 4.20 | 4.50 | 4.40 | 3.93 | 3.70 | 5.00 |
| Copper (as cyanide) | 2.01 | 2.10 | 2.50 | 2.13 | 2.62 | 3.62 |
| Zinc (as cyanide) | 1.37 | 1.45 | 1.85 | 1.54 | 2.00 | 2.79 |
| Total metal | 3.38 | 3.55 | 4.35 | 3.67 | 4.62 | 6.59 |
| % Copper in metal | 59.5 | 59.2 | 57.6 | 58.0 | 56.7 | 55.0 |

When plated as above described in each of the above electroplating baths the resulting deposits of brass were grainy in appearance and commercially unsuitable for use as undercoats for subsequent plating operations.

The plating experiments were then repeated with the same electroplating baths to which had been added varying amounts of different manganous compounds, including the following:

| | |
|---|---|
| Manganous gluconate | 0.005 g/l |
| Manganous carbonate | 0.0008 g/l |
| Manganous sulfate | 0.00025 g/l |

The addition of the above specified manganous compounds to each of the above baths gave electroplating baths which under the same plating conditions set out in Example I gave brass plates completely free from the undesirable grain structure present in the first set of plates.

EXAMPLE IV

In the next series of experiments the same basic baths were used as described in Example III to which were added the same manganous compounds used in the preceding Example, but in amounts approximately ten times those used in Example III. In each instance satisfactory brass plates completely free from grain were produced in the electroplating operation. However, with these concentrations of the manganous compounds some of the manganese compounds were precipitated during the plating operation, leaving an undesirable sludge in the electroplating bath.

EXAMPLE V

In this series of experiments the plating operations described in Example IV were repeated with the addition that to each electroplating bath was added varying amounts of different chelating or sequesterng agents to prevent precipitation of the manganous compounds used in the preceding experiments. The specified amounts of the following agents were added to each of the basic electroplyes to which had been added the larger amounts of manganous compounds specified in Example IV.

| | |
|---|---|
| Sodium gluconate | 0.15 g/l |
| Sorbitol | 0.3 g/l |
| Tartaric acid | 0.3 g/l |
| Citric acid | 0.3 g/l |
| Gluconic acid | 0.15 g/l |
| Ethylenediaminetetra-acetic acid | 0.15 g/l |

In each instance the electrodeposited brass was free from grain and completely satisfactory for subsequent electroplating and the electroplating bath was substantially free from precipitated manganese compound.

From the above series of experiments it is evident, therefore, that when manganous compounds are included in brass electrolytes to reduce or eliminate the formation of grain in the deposited coatings, it is desirable to include also small amounts of chelating or sequestering agents for the purpose of reducing the chances for the precipitation of manganese compounds in the electrolytes during the electroplating operation.

What is claimed is:

1. In an aqueous alkaline cyanide bath for electrodeposition of brass containing 4.45–8.56 oz/gal of sodium cyanide, 3.70–5.00 oz/gal of sodium hydroxide, 2.01–3.62 oz/gal of copper as cyanide and 1.37–2.79 oz/gal of zinc as cyanide, the improvement which consists in incorporating in said aqueous bath a water-soluble manganous compound in an amount sufficient to provide 0.00005–0.1 g/l of manganese.

2. In an aqueous alkaline cyanide bath for electrodeposition of brass according to claim 1, the improvement which consists in further including 0.001–10 g/l of a water-soluble chelating or sequestering agent.

3. In the process of electrodepositing brass from an aqueous alkaline cyanide electrolyte to produce a substantially grain-free brass coating containing 70–30%, by weight of copper and 30–70%, by weight, of zinc, the improvement which comprises having present in said electrolyte a water-soluble manganous compound in an amount sufficient to provide 0.00005–0.1 g/l of manganese.

4. In the process of electroplating brass from an aqueous alkaline cyanide electrolyte to produce a substantially grain-free brass coating containing 70–30%, by weight, of copper and 30–70%, by weight, of zinc, the improvement which consists in having present in said electrolyte a water-soluble manganous compound in an amount sufficient to provide 0.00005–0.1 g/l of manganese and 0.001–10 g/l of a water-soluble chelating or sequestering agent, and effecting said electrodeposition within a temperature range of 60°–90° F and at a current density within the range of 0.3–100 amperes/ft$^2$.

* * * * *